US008575851B1

(12) United States Patent
Bahrehmand

(10) Patent No.: US 8,575,851 B1
(45) **Date of Patent: *Nov. 5, 2013**

(54) PROGRAMMABLE LED DRIVER

(71) Applicant: Farhad Bahrehmand, Seven Hills, OH (US)

(72) Inventor: Farhad Bahrehmand, Seven Hills, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/727,793

(22) Filed: Dec. 27, 2012

Related U.S. Application Data

(63) Continuation of application No. 12/697,280, filed on Jan. 31, 2010, now Pat. No. 8,344,639, which is a continuation of application No. 12/324,200, filed on Nov. 26, 2008.

(60) Provisional application No. 61/207,152, filed on Feb. 9, 2009, provisional application No. 61/005,068, filed on Nov. 30, 2007.

(51) Int. Cl.
*H05B 41/16* (2006.01)

(52) U.S. Cl.
USPC ..... 315/247; 315/294; 315/307

(58) Field of Classification Search
USPC ..... 315/185 R, 247, 291, 294, 307, 312, 315/360, 362
See application file for complete search history.

(56) References Cited

U.S. PATENT DOCUMENTS 3,103,618 A 9/1963 Slater
5,357,566 A 10/1994 Dowling et al.
5,920,309 A 7/1999 Bisset et al.
6,304,039 B1 10/2001 Appelberg et al.
6,402,354 B1 6/2002 Tatewaki et al.
6,567,009 B2 5/2003 Ohishi et al.
6,940,733 B2 9/2005 Schie et al.
6,963,175 B2 11/2005 Archenhold
7,145,295 B1 12/2006 Lee et al.
7,242,393 B2 7/2007 Caldwell
7,557,521 B2 7/2009 Lys et al.
7,609,008 B1 10/2009 Kohler
7,649,327 B2 1/2010 Peng
7,852,017 B1 * 12/2010 Melanson ..... 315/291
7,863,828 B2 * 1/2011 Melanson ..... 315/247
2002/0060530 A1 5/2002 Sembhi et al.
2003/0127991 A1 * 7/2003 Cash et al. ..... 315/291
2003/0137258 A1 7/2003 Piepgras et al.

(Continued)

OTHER PUBLICATIONS

Texus Instruments Appl Report SSLA379-01-2008—10 Pages MSP430 Capacitive Single Touch Sensor Design Guide.

(Continued)

*Primary Examiner* — Tung X Le

(57) ABSTRACT

The present invention relates to a programmable LED driver to control a plurality of LEDs. The driver comprises an LED driver circuit, a programmable integrated circuit (PIC) such as a microprocessor, and capacitive touch pads. The driver receives a 110 volt AC current and is sized to fit within a standard 110 volt AC outlet box. The programmable integrated circuit is adapted to scan said touch pad array and generate an output signal to said LED driver circuit corresponding to said scan.

In an embodiment of the present invention, the touch pad array comprises a plurality of touch pads and the touch pads are the faceplate of a 110 volt AC outlet box.

A further embodiment of the present invention comprises a touch pad plate remote from the programmable integrated circuit, the touch plate comprising a plurality of capacitive touch pads wirelessly connected to the programmable integrated circuit.

12 Claims, 7 Drawing Sheets

(56) References Cited

U.S. PATENT DOCUMENTS

| | | | |
|---|---|---|---|
| 2003/0227375 | A1 | 12/2003 | Yong |
| 2003/0230982 | A1 | 12/2003 | Pagano et al. |
| 2004/0212321 | A1 | 10/2004 | Lys et al. |
| 2005/0116662 | A1 | 6/2005 | Sanchez |
| 2006/0113975 | A1 | 6/2006 | Mednik et al. |
| 2007/0052376 | A1 | 3/2007 | Lee |
| 2007/0124632 | A1 | 5/2007 | Chung et al. |
| 2007/0182347 | A1 | 8/2007 | Shteynberg et al. |
| 2008/0018261 | A1 | 1/2008 | Kastner |
| 2008/0192499 | A1 | 8/2008 | Gardner et al. |
| 2008/0285271 | A1 | 11/2008 | Roberge et al. |
| 2009/0015174 | A1 | 1/2009 | Huang et al. |
| 2009/0079355 | A1 | 3/2009 | Zhou et al. |
| 2009/0146583 | A1 | 6/2009 | Bhadri et al. |
| 2009/0224686 | A1 | 9/2009 | Kunimatsu |
| 2010/0052577 | A1 | 3/2010 | Brownlee |
| 2011/0018465 | A1 | 1/2011 | Ashdown |

OTHER PUBLICATIONS

Texas Instruments Appl Report SLAA481A-05-2012—20 Pages Two-Dimensional Capacitive Touch Implementation Using . . . .

Supertex HV 9910 LED Drive Data Sheet—2007.

Texas Instruments MSP43F11221 Microcontroller Data Sheet SLAS 241—Sep. 1999, 2000 REV.

National Semiconductor LM555 Data Sheet Jul. 2006.

CTS Corp Rotary Potentiometer Series 270 Data Sheet, Oct. 25, 2006.

* cited by examiner

PROGRAMMABLE LED DRIVER

RELATED APPLICATIONS

This application is a continuation-in-part of and claims the benefit of co-pending application Ser. No. 12/697,280, filed Jan. 31, 2010, titled "Programmable LED Driver", and Ser. No. 12/324,200, filed Nov. 26, 2008, titled "LED Driver and Integrated Dimmer and Switch". This application also claims the benefit of U.S. Provisional Application Ser. No. 61/207,152 filed Feb. 9, 2009 titled "Programmable LED Driver" and the filing date thereof. The disclosures of the aforementioned Pending and Provisional Applications are hereby incorporated herein in their entirety by reference hereto.

BACKGROUND OF THE INVENTION

1. Technical Field

The present invention relates to an LED driver for an array of light emitting diodes (LED's), and more specifically to an LED driver that is programmable.

2. Description of Prior Art

LED is abbreviation of "Light Emitting Diode", which is a small electronic device that lights up when an electric current is passed through it. The term diode refers to a family of two-pin semiconductor devices. The current can pass through them only in one direction. The first LED's were red. They were introduced to the market decades ago. The early red LED's quickly found applications as tiny indicators on audio equipment, TV's, and even digital wrist watches. Later, LED's were used as seven-segment display modules, and the first pocket calculators used them. Years of research has introduced all sorts of colorful LED's to the market. The most common LED's are red, green, yellow, blue, and orange. The color of LED is due to the material used in the LED chip not just the color of the package. In the past several years, the LED market has seen a big jump in the brightness of the LED's, and white LED's have been introduced that produce enough light that they have been used in cars and general lighting.

The main advantages of LED's are long life span (some exceeding 100,000 hours), and high efficiency compared to small tungsten or incandescent lights. Additionally, they generate very little heat when they are operated at the rated current. They can also take a harsh environment, as there is no filament in them. The disadvantages (at least when compared to 110V tungsten light bulbs) are that they can not directly replace incandescent lamps, and, a single LED is very small and cannot generate enough light to light up a room. Therefore, the LED's for generating a large amount of light are used in clusters. Some designers use them in series strings, some use them in parallel strings, and some use them in a combination of series and parallel strings.

The LED's are normally used in constant-current circuits. The early LED's required only 10 milliamperes to operate. Many new ultra-bright white LED arrays require a current of 750 milliamperes or more to operate at maximum brightness.

The term "LED driver" refers to any kind of electronic circuit that produces the current and voltage necessary to turn on a specific LED or cluster of LED's. For example, some LED drivers can take as input the 12VDC from a car battery, and generate enough current to turn on a combo cluster of 20 LED's used in a tail light. Another example is an LED driver that turns on a combo of LED clusters used as the backlighting for flat panel LCD displays (the LED's have effectively replaced fluorescent back lighting).

The LED driver for commercial and residential lighting is different because the input voltage is 110 volts AC. This voltage needs to be converted to DC and also it needs to be regulated such that it does not feed more than the necessary amount of current to the LED's. If the LED's are driven by higher currents and voltage than their rated values, their life span will significantly shorten or they may even burn out quickly.

Currently, lighting fixture companies use LED drivers for fixtures such as chandeliers that are so large they can barely fit into the ceiling or fixture canopy. The drivers also do not have any onboard or external dimmer. It has been proposed to use a conventional incandescent 110 volt AC dimmer for dimming LED's. This is an awkward way of solving the problem because two units have to be installed, one in the ceiling and one in the wall outlet for the fixture. In addition, there are compatibility issues between LED drivers and incandescent dimmers.

Published US application 2004/0212321 discloses an LED driver configured to provide power from an AC 110 volt circuit to a plurality of LED's. The driver gets its power from rectified standard AC voltage. Further, a conventional AC dimmer is used for dimming functionality.

Published US application 2006/0113975 discloses controlling output current of a DC/DC converter. While this circuit could be employed in an LED driver, it does not disclose the technology of the present invention.

U.S. Pat. No. 6,940,733 discloses a power supply using a frequency modulated pulse train for optimal power conversion. The circuitry of the present invention employs a programmable fixed frequency.

U.S. Pat. No. 7,145,295 discloses a simple design for controlling light emitting diodes. While this design could be used for dimming LED's, it does not disclose a technology as how to power, dim, and switch LED's on/off in an offline application that could also be fit in an AC outlet for lighting applications.

Published Data Sheet HV9910 titled "Universal High Brightness LED Driver" by Supertex, Inc, 1235 Bordeaux Drive, Sunnyvale, Calif., 94089, discloses a PWM high efficiency LED driver control IC. It allows efficient operation of High Brightness (HB) LED's from voltage sources ranging from 8VDC up to 450VDC. The HV9910 controls an external MOSFET at fixed switching frequency up to 300 kHz. The frequency can be programmed using a single resistor. The LED string is driven at constant current rather than constant voltage, thus providing constant light output and enhanced reliability. The output current can be programmed between a few milliamps and up to more than 1.0 A. The HV9910 uses a rugged high voltage junction isolated process that can withstand an input voltage surge of up to 450V. Output current to an LED string can be programmed to any value between zero and its maximum value by applying an external control voltage at the linear dimming control input of the HV9910. The HV9910 provides a low-frequency PWM dimming input that can accept an external control signal with a duty ratio of 0-100% and a frequency of up to a few kilohertz.

It is known to combine a microprocessor with a touch sensor to perform certain functions. For instance, U.S. Pat. No. 5,357,566 discloses a programmable telephone dialing device that employs a microcontroller activated by a touch sensor. Published patent application Number 2007/0124632 discloses a touch sensing device for sensing electricity signals of an object. U.S. Pat. No. 5,920,309 discloses a capacitive touchpad that transmits signals to a microcontroller. In published application Number 2003/022737, a microcontroller selects a text message corresponding to a particular touch sensor signal and transmits it to a display screen. This is accompanied by an audible signal that provides the operator with positive feedback indicating selection of the correct message.

SUMMARY OF THE INVENTION

The present invention relates to an LED driver for an array of light emitting diodes (LED's), and more specifically to an LED driver that is programmable. The driver comprises an LED driver circuit adapted to receive a 110 volt AC current and to rectify said AC current into a low voltage DC output current. The driver comprises a programmable integrated circuit (PIC) such as a microprocessor and a capacitive touch pad array operatively connected with the programmable integrated circuit. A means operatively connects the programmable integrated circuit with the LED driver circuit. The programmable integrated circuit is adapted to scan said touch pad array and generate an output signal to said LED driver circuit corresponding to said scan. The programmable integrated circuit is powered by low voltage DC current from said LED driver circuit. The LED driver circuit and programmable integrated circuit are sized to fits within a standard 110 volt AC outlet box or similar enclosure.

In an embodiment of the present invention, the touch pad array comprises a plurality of touch pads and the touch pads are the faceplate of a 110 volt AC outlet box.

A further embodiment of the present invention comprises a touch pad plate remote from the programmable integrated circuit, the touch plate comprising a plurality of capacitive touch pads wirelessly connected to the programmable integrated circuit.

BRIEF DESCRIPTION OF THE DRAWINGS

The present invention and advantages thereof will become more apparent from reference to the following detailed description with reference to the accompanying drawings, in which:

FIG. 4 is a drawing from a Texas Instrument Application Note SLAA379, published January 2008;

DETAILED DESCRIPTION OF THE PRESENT INVENTION

Figure 1:
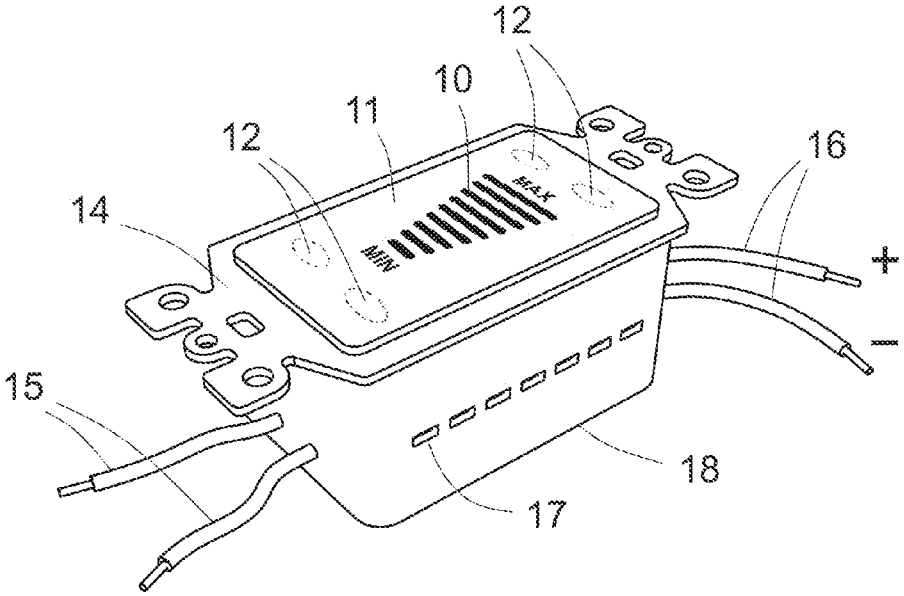
FIG. 1 is a perspective view of a programmable LED driver according to the present invention.

FIG. 1 provides an overview of the present invention using an integrated capacitive touch pad sensing technology as the user interface.

An enclosure 18 houses all the components of the invention and is small enough to fit into a standard 110 volt AC outlet box. The enclosure 18 is made of a code approved material, and is attached to a mounting bracket 14. The mounting bracket 14 secures the assembly onto a standard AC outlet using two or more screws (not shown). The mounting bracket 14 is made of a thin metal, such as aluminum, such that it can be grounded for safety (grounding wire not shown).

The enclosure 18 comprises touch pad sensors having a face plate 11. The face plate 11 functions as the face plate for the AC outlet box. Touch pad sensors are well known. All the functions of the present invention are operated by one or more capacitive touch sensitive pads 10 and 12 (shown in phantom lines) positioned underneath the face plate 11. Capacitive touch pads 10 have been arranged to form a touch slider to control the brightness level of LED's and to turn the LED's on/off, in a manner to be described. The touch slider 10 is preferably located beneath the center of the faceplate 11 for easy access. One or more touch sensitive pads 12 are used to activate a timer for scheduled on/off of the LEDs, and to activate random on/off of the LEDs. Additional touch pad sensors could be employed to program other desired tasks, but the critical tasks are dimming, timed or scheduled on/off and random on/off.

The leads 15 connect to 110VAC power line. The leads 16 are DC output leads that connect to one or more or an array of LED's. Openings 17 permit air circulation for cooling the components in the enclosure 18. It is important to note that since the touch sensitive pads 10 and 12 are located underneath the faceplate 11, there is no wire or conductor situated on the faceplate 11. This provides a very safe, reliable operation even in the harshest environments such as areas where explosive gases could be in the vicinity, or outdoor outlets which are exposed to rain, snow, and frost.

Figure 2:
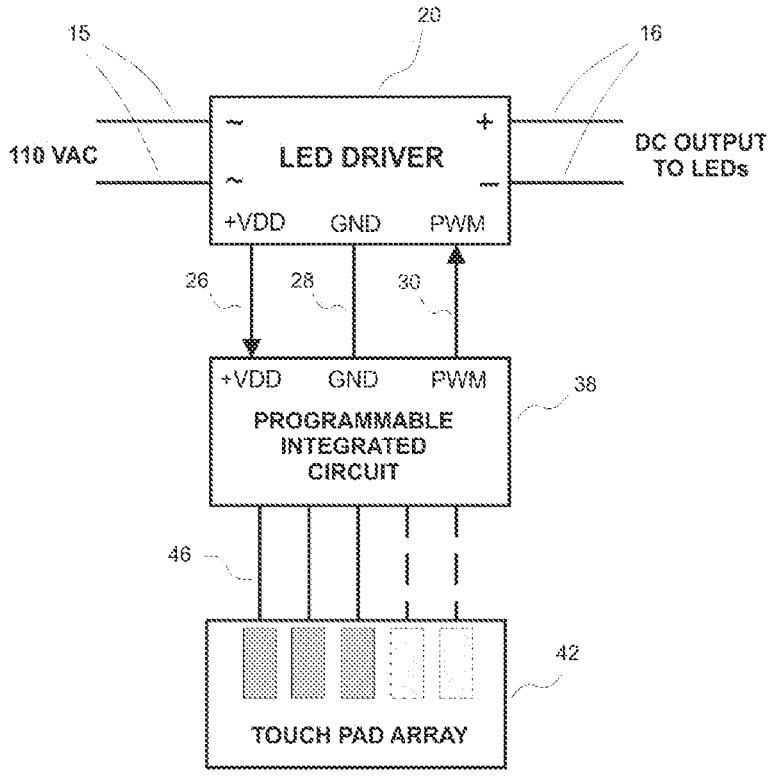
FIG. 2 is a schematic illustration showing the circuitry of the programmable LED driver of FIG. 1.

FIG. 2 is a block diagram of a PWM generator in accordance with the present invention. A touch pad array 42 communicates directly, via data interface lines 46, with a programmable integrated circuit 38. The programmable integrated circuit 38 continuously scans the touch pad array 42 for proximity of a finger (via the data interface lines 46). If proximity is detected, the programmable integrated circuit 38 performs a task based on what pad in the touch pad array 42 has been touched. Depending on the task, the programmable integrated circuit 38 provides a PWM output signal to LED driver circuit 20 by means of lead 30, which signal is inputted by the LED driver to control the DC output in leads 16 to the one or more or array of LED's. The LED driver circuit 20 includes a "buck driver" (to be described) and converts a110 volt alternating input AC current 15 to low voltage DC output current 16, suitably programmed by the PWM signal for driving one or more or an array of LED's.

Also shown in FIG. 2 is lead 26 that provides low voltage DC power from the LED driver circuit 20 to the programmable integrated circuit 38 suitable for powering the programmable integrated circuit 38. This feature of the present invention avoids the use of a bulky transformer thereby allowing the LED driver of the present invention to be packaged small enough to fit within a standard 110 volt AC outlet box. Lead 28 is to ground. One suitable programmable integrate circuit is a programmable microcontroller marketed by Texas Instruments under the trade designation MSP430.

Figure 4:
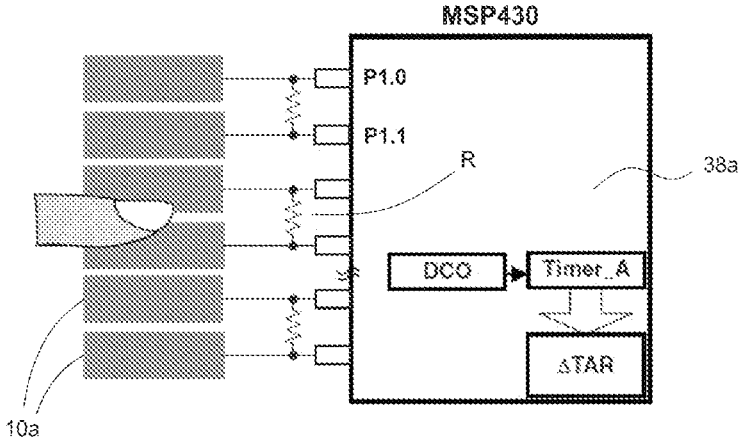
FIG. 4 illustrates schematically the connection between a programmable integrated circuit (PIC) useable in the programmable LED driver of FIG. 2 and a capacitive touch pad sensor.

Application Note SLAA379 from Texas Instruments details the design of a touch sensor circuit using the MSP430 microcontroller with no need for a capacitive touch sensor integrated circuits. FIG. 4 herein, taken from FIG. 4 of the Application Note SLAA379, shows how six pads 10*a* are connected to an MSP430 microprocessor 38*a*. In FIG. 4, "DCO" is a Digitally Controlled Oscillator, "Timer A" is one of the onboard timers, and "TAR" is a Timer Register.

When there is no proximity of a finger, the digitally controlled oscillator DCO generates a frequency based on the value of a resistor R and the capacitance formed between two adjacent pads. This frequency (i.e. the number of pulses per second that the DCO generates) is stored in the onboard digital Timer A of MSP430. Proximity of a finger to a pad 10*a*, changes the capacitance between two pads. This in turn causes a change to the frequency of the DCO, because the frequency of the DCO depends on the resistor R and the capacitance of the pads. The change in frequency is stored in a Timer Register TAR). The microcontroller 38*a* can detect the change in frequency due to proximity of a finger and translate that into a signal to the LED driver circuit 20 by means of lead 30 (FIG. 2).

FIG. 9 in the same Application Note shows how a slider function can be implemented using the same microcontroller. Additionally, FIG. 14 in the SLAA379 Application Note describes how two MSP430 microcontrollers can be used in a touch pad demonstration circuit: one to interface directly to the touch pad sensors, and the other as a host to process the touch pad data received from the first microcontroller.

The Texas Instrument Application Note SLAA379 is incorporated herein by reference, and can be accessed on the Texas Instrument website.

In this embodiment of the present invention, the touch pad sensor comprises a plurality of touch pads that can be the faceplate of a 110 volt AC outlet box or similar small enclosure.

Figure 5:
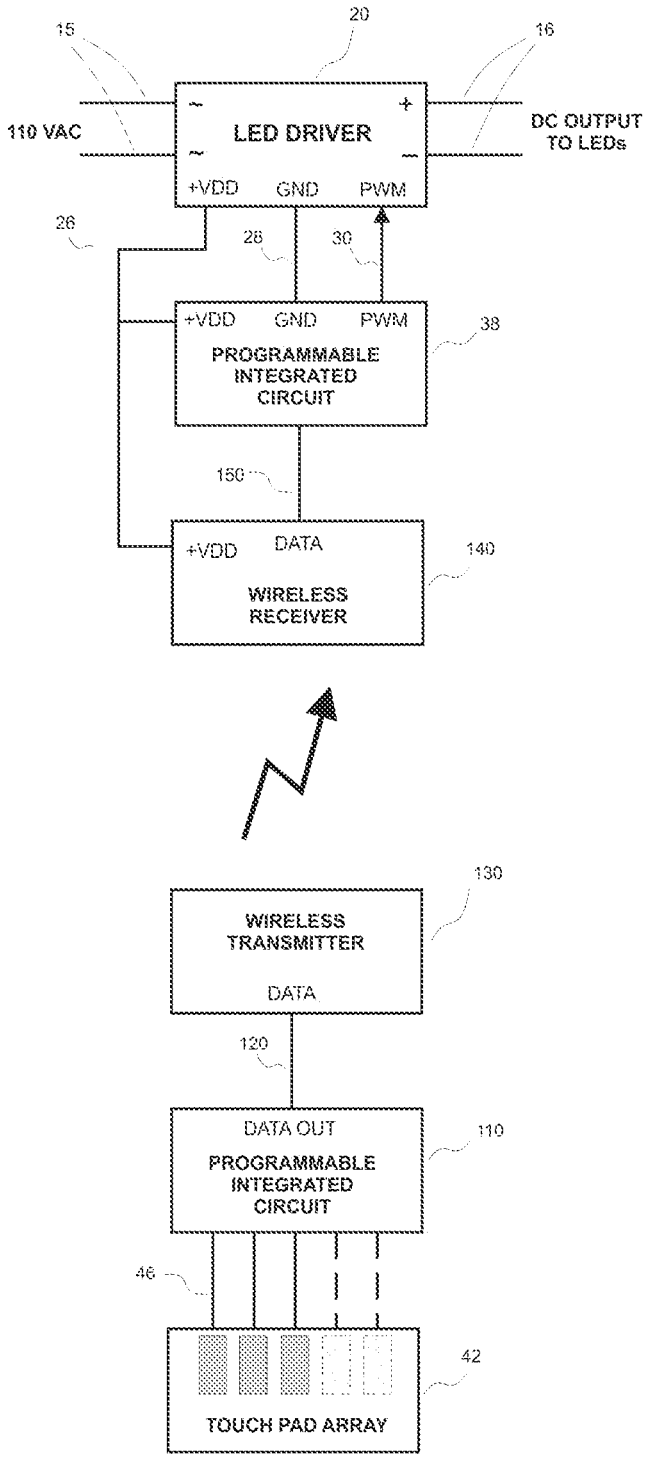
FIG. 5 is and embodiment of the present invention wherein the data from a touch pad array is wirelessly transmitted to an LED driver.
Figure 6:
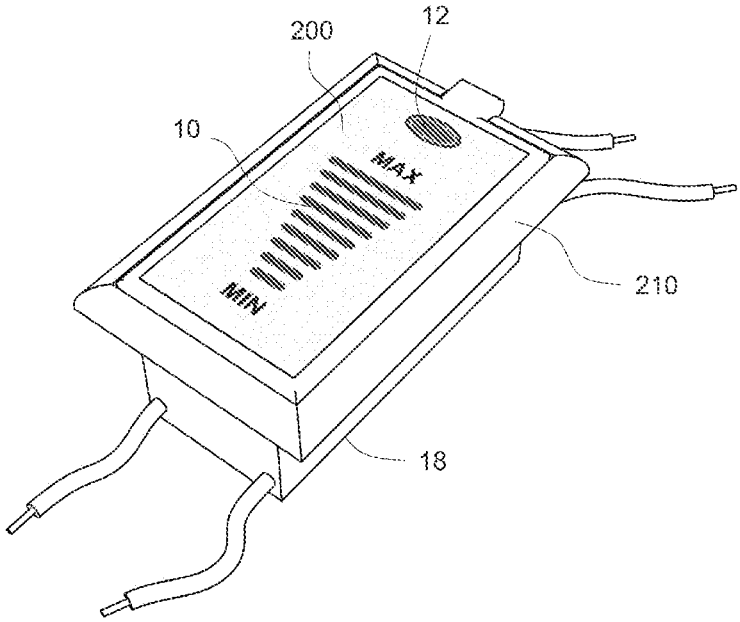
FIG. 6 is a perspective view of the programmable driver of FIG. 5.
Figure 7:
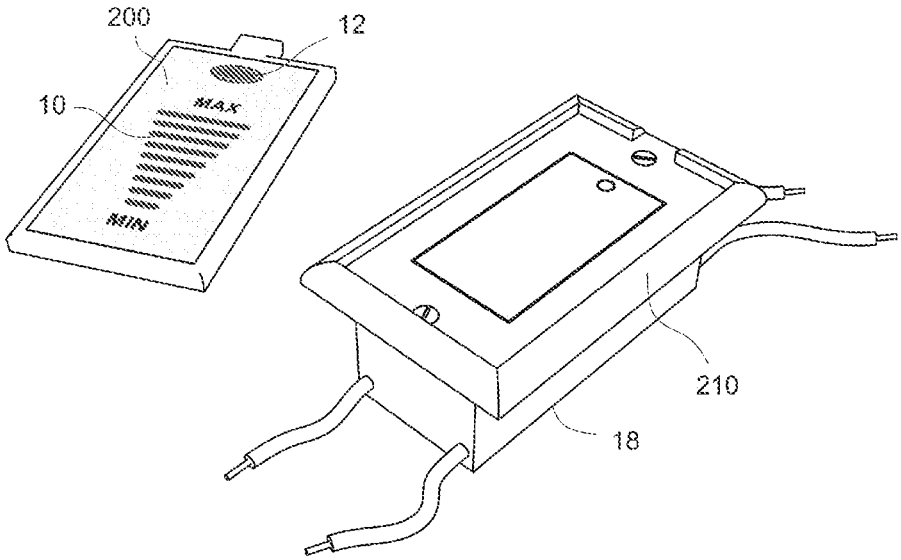
FIG. 7 is a further view of the driver of FIG. 6.

In a further embodiment of the present invention, the data from a touch pad array, such as finger proximity data for dimming or for ON/OFF, is wirelessly transmitted to a programmable integrated circuit (PIC) such as a microprocessor. Referring to FIGS. 5, 6 and 7, a touch pad array 42 (FIG. 5) communicates directly, via data interface lines 46, with a programmable integrated circuit 110, such as a microprocessor. The programmable integrated circuit 110 converts touch pad input from the touch pad array 42 to serial data that is sent to RF or IR transmitter module 130 via leads 120. Details of an RF or TR transmitter are well known to those skilled in the art. The transmitted touch pad data is received by an RF or IR receiver module 140 (FIG. 5). The received data is transmitted via lead 150 to programmable integrated circuit 38 (e.g., a microprocessor) where it is decoded and converted to PWM data, which in turn is transmitted to LED driver 20 by means of lead 30. The RF or IR module 140 (FIG. 5) is powered by the same small DC voltage that powers the programmable integrated circuit 38.

As shown in FIGS. 6 and 7, the touch pad array 42, programmable integrated circuit 110, and transmitter 130 are housed in a thin plate 200 separate from the LED driver components housed in a 110 volt AC outlet box 210 or similar enclosure. As shown in FIG. 7, the separate plate 200 with integral touch pads can be detached from the wall plate for wireless dimming or ON/OFF switching. This separate touch plate 200 can be constructed very thin and house an onboard touch pad array, RF or IR modules, and onboard batteries. When not in use, the external detachable touch plate 200 may be placed on the permanent wall plate by various means such as a few embedded magnets placed on the corners of the wall plate or also on the corners of the external touch plate 200(see FIG. 6) This embodiment has the same advantage as stated above, that powering the programmable integrated circuit (PIC) 38 with low voltage DC current from the LED driver circuit allows the driver to be housed in a small enclosure such as a 110 V AC outlet box Instead of a microprocessor, other programmable integrated circuits can be employed, such as a "field" programmable gate array (FPGA), or an application specific integrated circuit (ASIC). In the case of the latter, the circuit is factory programmed. By "factory programmed", it is meant that the circuit is programmed either at the factory or by other than in the "field"; e.g., by other than the end user. An application specific integrated circuit (ASIC) is a circuit that is designed and customized for a specific application. For example, an ASIC designed for the present invention, will solely perform the functions necessary to operate an LED driver as described; as such it cannot be redesigned or reprogrammed to operate a microwave oven. Therefore, such an ASIC will not be considered a standard integrated circuit useful for other tasks.

Figure 3:
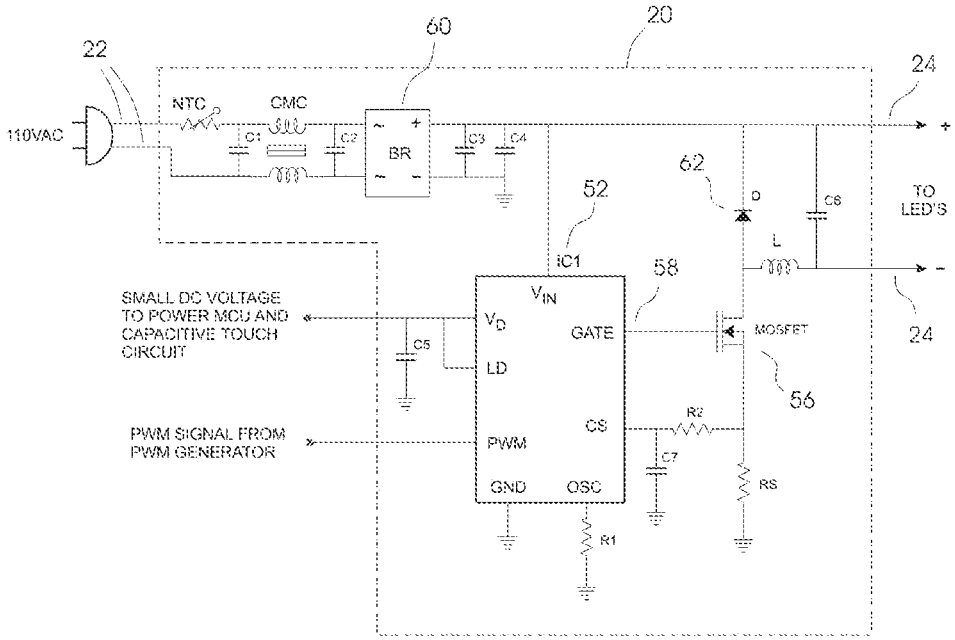
FIG. 3 is a schematic illustration showing details of the LED driver circuit of FIG. 2.

Details of the LED driver circuit 20 are shown in FIG. 3. Bridge rectifier 60 converts a 110 v AC current in leads 22 to a high voltage DC current. The LED driver circuit 20 includes an integrated driver control circuit (IC1) 52 marketed by Supertex Inc under the trade designation HV9910. The HV9910 control circuit 52 shown in FIG. 3 is a DC-DC switching converter called a buck-converter. The term "buck" refers to DC-DC switching converters that convert a high DC voltage to a low DC voltage. The operation of the HV9910 control circuit 52 is explained in detail in the HV9910 data sheets, incorporated by reference herein. The HV9910 control circuit 52, among other things, converts the high DC voltage from bridge rectifier 60 (pin $V_{in}$) to a low DC voltage (pin $V_D$) that is useful in powering the microcontroller 38 (FIG. 2), in the manner described above.

There are two methods for dimming LED's: analog; and PWM (pulse width modulation). Analog dimming is achieved by reducing the current in the LED's. PWM dimming is achieved by reducing the duty cycle of the applied PWM current while keeping the current in the LED's at a maximum Analog dimming in a string of LED's for lighting has a major drawback, namely an LED color shift. Lowering the LED current causes a subtle change in radiant wavelength. As such, PWM dimming is the preferred method of dimming LED's used in the lighting industry because the LED current remains constant as the LED's are dimmed. The present invention employs PWM dimming.

Pulse width modulation (PWM) is the process of switching a DC voltage ON and OFF at a given or fixed frequency, with varying ON and OFF times. These ON and OFF times are referred to as the "duty cycle", which is defined as the ratio of the ON time of the PWM signal to its period (period being the time of one complete cycle). The LED's are dimmed by reducing the duty cycle of the PWM signal in a manner to be described. The more the ON time, or the greater the duty cycle, the brighter the LED's. When the duty cycle is at 1%, the LED's are very dim, and when the duty cycle is more than 99%, the LED's are fully lit. If the frequency of the PWM signal is high enough, the LED's appear at a flicker free brightness to human eyes. As will be described, the PWM signal is applied at a frequency higher than 100 Hz, faster than the eyes can detect.

With reference to FIGS. 2 and 3, the functions of the microcontroller 38 are accomplished by applying a PWM signal from microcontroller 38 (FIG. 2) to the pin "PWM" of the HV9910 control circuit 52 (FIG. 3). Dimming is accomplished by reducing the duty cycle of the applied PWM signal. The HV9910 control circuit 52 provides a low frequency PWM dimming input that can accept an external control signal with a duty ratio of 0-100% and a frequency of up to a few kilohertz.

The HV9910 control circuit 52 controls an external MOSFET transistor 56 via gate 58. The term MOSFET stands for Metal Oxide Semiconductor Field Effect Transistor. It is a sensitive low loss transistor that is used in high speed switching. Conventional transistors dissipate a lot of energy when used as a switch. The dissipation is mainly due to junction resistance and capacitance among other things. MOSFETS have very low ON resistance and capacitance. The MOSFET 56 is programmed to have a fixed switching frequency up to 300 KHz. The microcontroller 38 through the HV99110 control circuit 52 controls the duty ration of the switching. The HV9910 control circuit has inductance. When the external MOSFET 56 is switched on by the "gate" output of the HV9910 control circuit 52, the MOSFET 56 acts like a "closed switch" and the current is stored in inductor (L) in the form of a magnetic field. When the MOSFET is switched off by the "gate" output of the HV9910 control circuit 52, the flow of current through the MOSFET stops and the stored energy is discharged to the array of LED's through diode 62. The output current can be programmed between a few milliamps and up to more than one amp, depending on the number of LED's in an LED string.

Other aspects of the LED driver 20 are disclosed in parent application Ser. No. 12/324,200, filed Nov. 11, 2008, incorporated by reference herein. It should be noted that other technologies of buck converters may be employed to build an LED driver, which is known to those skilled in the art.

In the present invention, the touch pad sensor 10 (FIG. 1) replaces a conventional switch such as a simple mechanical momentary push-button switch. In operation, the microcontroller 38 is programmed to take action upon the finger proximity For example, it could toggle a light on/off with every proximity Or, it could change the duty cycle of the PWM signal if the proximity is maintained for more than three seconds (hence dimming). So, by intelligently programming the microcontroller 38, it is very easy to detect the finger proximity to one or more touch pads and take a desired action.

By way of example, for dimming, the microprocessor 38 can provides a "slider" control (item 10, FIG. 1) using only four touch pads, such that a finger can actually slide in a linear path of the four pads. The four pads are placed about 1" apart on a line. Sliding a finger in the linear path can change a code in the microprocessor 38 to a number between 0 and 255. This is used to set the dimming level in 255 levels (i.e. resolution of 255). Placing the finger on the top of the slider will set the code to 255 (max duty cycle, full brightness), and placing finger on the bottom of the slider will set the code to 0 (min duty cycle, min brightness or off). Other suitable capacitive touch pad circuits may be employed for finger proximity sensing. However, the microcontroller 38 may have to be programmed accordingly.

For the automatic scheduled or timed "on/off" function, one or more pads 12 (FIG. 1) may be used. For instance, one pad may be provided so that when touched the LED light(s) will go on for a fixed period. At the end of the period, the LED light(s) will turn off. After that, the LED light(s) will not turn on unless the same pad is touched again. For example, if the fixed period is 9 hours, the first employee that comes to work will turn the light(s) on using this feature. The light(s) will automatically turn off after nine hours or so and no energy will be wasted if an employee forgets to turn off the light(s). Alternatively, this function can be programmed to turn on a light at a predetermined time and then turn it off, again at a predetermined time; or in other ways as desired.

For the random function, one or more pads (12, FIG. 1) correspond to a certain random duration for on/off. One pad is used for random events that have periods of, for example, one to five hours. One pad could be used for random events that have random periods of, for example, 10 to 20 hours, etc. In general, one pad may be sufficient for this function.

One advantage of the present invention is that by using a touch sensor as the face plate for an ordinary 110 volt outlet box, the outlet box is provided with additional space for the other components of the LED driver of the present invention.

From the above description of the present invention, those skilled in the art may perceive improvements, modifications and changes. Such improvements, modifications, and changes within the skill of the art are intended to be covered by the claims appended hereto.

What is claimed is:

1. A programmable LED driver comprising;

a. an LED driver circuit adapted to receive a 11OVAC current and to rectify said AC current into a low voltage rectified DC output current;

b. a programmable integrated circuit (PIC);

c. means operatively connecting said programmable integrated circuit with said LED driver circuit;

d. a capacitive touch pad sensor capable of producing data;

e. one or more touch pads operatively connected with said capacitive touch pad sensor;

f. said programmable integrated circuit being programmable to accept said data as input and generate an output signal to said LED driver circuit corresponding to said data; and g. said means of paragraph c. providing a low voltage DC current to said programmable integrated circuit and to said capacitive touch pad sensor, said LED driver circuit and programmable integrated circuit being adapted to fit within a standard 110 volt AC outlet box or similar small enclosure.

2. The LED driver of claim 1 wherein said one or more touch pads and touch pad sensor is the faceplate of a 110 volt AC outlet box.

3. The LED driver of claim 1 comprising means wirelessly connecting the one or more touch pads and touch pad sensor with the programmable integrated circuit.

4. The LED driver of claim 3 comprising a thin touch pad plate separable from the LED diver circuit, the touch pad plate housing a transmitter, the one or more touch pads and touch pad sensor.

5. The LED driver of claim 4 wherein one or more of said touch pads functions for dimming such that said programmable integrated circuit generates a PWM signal having an adjustable duty cycle for dimming said LED's.

6. The LED driver of claim 5 wherein said programmable integrated circuit is a microprocessor.

7. The LED driver of claim 5 wherein the touch pad for dimming is a touch slider.

8. The LED driver of claim 1 wherein said programmable integrated circuit generates a PWM signal having an adjustable duty cycle.

9. The LED driver of claim 1 wherein one or more of said touch pads functions for dimming such that said programmable integrated circuit generates a fixed frequency PWM signal having an adjustable duty cycle for dimming said LED's; one or more of said touch pads functions for timed on/off function such that said programmable integrated circuit enables/disables said PWM signal to automatically turn on/off said LED's; and one or more touch pads functions for random on/off function such that said programmable integrated circuit randomly enables/disables said PWM signal to randomly turn on/off said LED's.

10. A programmable LED driver for an array of light emitting diodes (LED's) comprising;

a. an LED driver circuit adapted to receive a 110 volt AC current and to rectify said AC current into a low voltage DC output current;

b. a programmable integrated circuit (PIC);

c. a means operatively connecting the programmable integrated circuit with the LED driver circuit;

d. means providing the programmable integrated circuit with low voltage DC current from said LED driver circuit to power the programmable integrated circuit;

e. the LED driver circuit and programmable integrated circuit being sized to fits within a standard 110 volt AC outlet box or similar enclosure, f. a capacitive touch pad array operatively connected with the programmable integrated circuit; the programmable integrated circuit being adapted to scan said touch pad array and generate an output signal to said LED driver circuit corresponding with said scan.

11. The LED driver of claim 10 wherein said capacitive touch pad array is the face plate of a 110 volt AC outlet box.

12. The LED driver of claim 10 comprising a thin housing separable from said LED driver circuit wherein said capacitive touch pad array is the faceplate of said thin housing, said housing comprising means wirelessly connecting the touch pad array with the programmable integrated circuit.

* * * * *